United States Patent [19]

Bardenheuer et al.

[11] 4,274,867

[45] Jun. 23, 1981

[54] METHOD FOR PRODUCING LOW-CARBON STEEL FROM IRON ORES CONTAINING VANADIUM AND/OR TITANIUM

[75] Inventors: Friedrich Bardenheuer, Krefeld; Horst Konig, Duisburg; Alois Junker, Dusseldorf; Gero Rath, Mulheim, all of Fed. Rep. of Germany

[73] Assignee: Mannesmann Aktiengesellschaft, Dusseldorf, Fed. Rep. of Germany

[21] Appl. No.: 72,186

[22] Filed: Sep. 4, 1979

[30] Foreign Application Priority Data

Nov. 2, 1978 [DE] Fed. Rep. of Germany ..... 2847403

[51] Int. Cl.[3] ..... C21C 5/52

[52] U.S. Cl. ..... 75/13; 75/10 R; 75/11

[58] Field of Search ..... 75/10–13

[56] References Cited

U.S. PATENT DOCUMENTS

| | | | |
|---|---|---|---|
| 2,805,930 | 9/1957 | Udy | 75/11 |
| 3,033,673 | 5/1962 | Collin | 75/11 |
| 3,150,958 | 9/1964 | Collin | 75/11 |
| 3,163,520 | 12/1964 | Collin | 75/11 |
| 3,579,328 | 5/1971 | Aas | 75/130 R |

*Primary Examiner*—P. D. Rosenberg

*Attorney, Agent, or Firm*—Mandeville and Schweitzer

[57] ABSTRACT

Methods are provided for producing in a single method low-carbon steel, while at the same time selectively obtaining a slag high in vanadium content for separate applications. Moreover, the method allows for the separate production of a slag high in titanium content if the starting materials contain titanium. The above is achieved by introducing the pre-reduced ore directly to an electro slag resistance furnace which is lined with a refractory in accordance with the slag composition being used. The resulting smelted steel is tapped and the slag is tapped separately. The slag, containing the vanadium and small quantities of iron oxides, is then introduced into a reduction furnace. Slag, high in titanium dioxide, if present originally, is then tapped separately from the smelted crude iron, which is tapped with a high vanadium content. Subsequently, the crude iron may be separated from the vanadium in a shaking pan in the presence of oxygen, if so required, depending upon the desired product.

6 Claims, 1 Drawing Figure

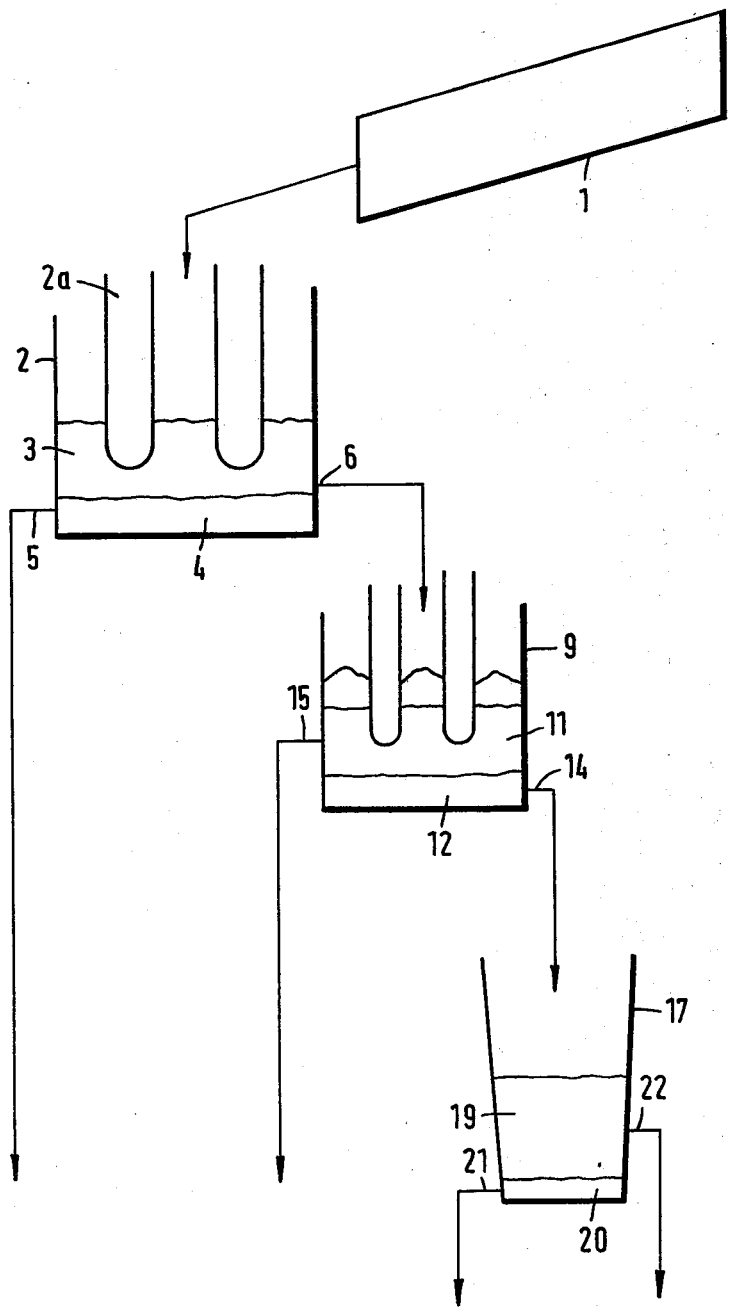
1
2a
2
3
6
5
4
9
15
11
14
12
17
22
19
21
20

METHOD FOR PRODUCING LOW-CARBON STEEL FROM IRON ORES CONTAINING VANADIUM AND/OR TITANIUM

BACKGROUND AND DESCRIPTION OF THE INVENTION

The invention is for methods for producing low-carbon steel from iron ores containing vanadium and/or titanium. The ore is, to a large extent, pre-reduced in a direct reducing plant, and then further processed in a smelting furnace. Finally, the smelted metal, as well as the enriched slag, are tapped and further processed.

The vanadium contained in some iron ores as admixture and/or the vanadium compounds constitute a valuable by-product in the iron production. When processing iron slags containing vanadium, ferro-vanadium may be obtained which is used in steel alloys, for example, or vanadium oxides which are important in the chemical industry, and particularly vanadium pentoxide ($V_2O_5$), which is useful as a catalyst in the production of sulfuric acid or dyestuffs.

In the known methods for producing iron by direct reduction, it was impossible, in the processing of iron ores containing titanium or vanadium, to obtain crude iron with higher concentrations of vanadium and/or slag with higher vanadium contents. In known methods for processing iron ores containing titanium or vanadium (Jessop, Medley, Sainsbury: "Steelmaking with New Zealand Iron Sands", Iron and Steel Institute, London, May 1971; Bold, Evans: "Direct Reduction Down Under", Iron and Steel International, June 1977) the ores with the carbon carriers required for the reactions in a revolving tubular oven, as well as for the following reduction in electric furnaces, are fed to a revolving tubular oven with the additions. In this furnace, the volatile components of the carbon compounds are driven out, the ores are heated and the Fe-oxides are partially pre-reduced. The carbonated additions are decomposed in the process.

The entire contents of the revolving tubular oven reach an insulating vat or vessel after pre-reduction, and are charged into an electro reduction furnace while hot. This reduces the iron, as well as the major portion of the vanadium. The crude iron containing vanadium is tapped, and the slag containing the greater portion of the vanadium oxides in low concentration is removed separately. Subsequently, the vanadium in the crude iron is slagged by addition of oxygen in a shaking pan. In order to maintain the carbon content in the crude iron, carbon carriers are added to the shaking pan. The slag containing the $V_2O_5$ is removed from the pan while the crude iron is brought to an oxygen blast converter, where it is blasted and becomes steel.

In methods of this kind, the vanadium is bound to a large quantity of crude iron. This permits only the production of crude iron with a low vanadium content. Accordingly, the slag produced by blasting the crude iron is of a relatively low vanadium content.

It is the object of this invention to use the method as initially described to obtain crude iron with much higher vanadium concentrations, as well as slags with much higher vanadium contents. This is solved by a method for producing low carbon steel from iron ores containing vanadium and/or titanium, the steps which comprise selecting said ores containing vanadium and/or titanium, pre-reducing said ores in a pre-reduction oven, the improvement characterized by charging said pre-reduced ores directly into a smelting aggregate together with carbon carriers, said smelting aggregate containing a molten slag layer and lined with a refractory material selected according to the matrix of the molten slag layer, said carbon carriers being only slightly in excess of the stoichiometric quantity required to reduce the iron in said ores, smelting said charged ores into steel, tapping said smelted steel from said smelting aggregate, tapping said slag layer containing vanadium and small quantities of iron oxide from said smelting aggregate, introducing said tapped slag layer into an electric furnace, processing said tapped slag layer in said electric furnace into smelted crude iron high in vanadium content, and transferring said vanadium from said crude iron to a slag rich in vanadium pentoxide under oxidizing conditions.

In the method of this invention, the iron ore containing titanium and/or vanadium is pre-reduced to a large extent and metalized. The material is then introduced into an electro-slag-resistance furnace, contrary to the conventional reduction furnace, for the production of ferro alloys and crude iron. No solid charge column exists above the slag layer in the electro-slag-resistance furnace. The furnace is lined with suitable refractory material, depending upon the matrix of the slag. If the excess carbon amounts to only little above the stoichiometric quantity of the iron to be reduced, the iron is only reduced, not carburized, while the vanadium oxide remains in the matrix slag due to excessive oxygen potential. Only a small portion of the vanadium merges with the steel bath which is tapped, and finished as steel.

The matrix slag containing vanadium, as well as other matrix components and small quantities of iron oxides, is tapped and then further processed in an electro reduction furnace of conventional design. The small quantity of crude iron with increased vanadium content smelted in the reduction furnace is tapped, and either utilized directly as iron-vanadium-alloy, or, for example, further processed in a connected shaking pan by the addition of oxygen into a primary slag with high vanadium content. The remaining small quantity of crude iron, low in vanadium, can be used in other ways. The tapped slag, rich in titanium oxide, if, for example, the basic materials contained a high percentage of Ti-O coming from the reduction furnace, may be further processed.

In a further feature of the invention, the smelted steel from the electro-slag-resistance furnace may be superheated and refined in a properly small electric arc furnace by the addition of steel with a new slag (duplex method). The duplex method is used, advantageously, in those cases where special quality requirements exist for the steel, and where the phosphorus and sulfur values of ores and coal ashes necessitate a base treatment in the steel furnace.

The particular advantages of the method of this invention consist in the fact that the vanadium is bound to a very small quantity of crude iron. This makes it possible to obtain crude iron with a very high concentration of vanadium and to produce, by blasting, a slag with high vanadium content.

DESCRIPTION OF THE DRAWING

The schematic drawing illustrates an example of apparatus for carrying out the method of the invention.

DETAILED DESCRIPTION OF THE INVENTION

The iron ore containing titanium and/or vanadium is pre-reduced in a revolving tubular oven 1 and charged, together with carbon carriers, into an electro-slag-resistance furnace 2, whose electrodes 2*a* are immersed in the slag layer 3. The furnace 2 is lined with a refractory material whose composition depends on the slag matrix. In the example shown, corundum was used in the admixture for the refractory.

The smelted steel 4 with low vanadium content is tapped at 5, while the matrix slag containing vanadium, and also low quantities of iron oxides, is taped at 6 and fed to a subsequent electro reduction furnace 9. After the smelting process, the smelted crude iron 12 containing carbon with an increased vanadium content is tapped at 14, and transferred to a metallurgic vessel, such as shaking pan 17, where it is further processed.

The slag 11, rich in titanium oxide, is removed from the furnace through tap hole 15 for further use. Oxygen is added to the shaking pan 17 and the vanadium contained in the iron containing carbon is transferred to a $V_2O_5$-rich slag 19, which is tapped at 22. The remaining crude iron 20 is removed from the pan through tap hole 21.

We claim:

1. A method of producing low carbon steel having a relatively high vanadium concentration from iron ore containing vanadium, comprising the steps of:

(a) pre-reducing said iron ore in a pre-reduction oven;

(b) lining an electro-slag resistance furnace with a refractory material selected according to the desired composition of the molten slag layer;

(c) charging said pre-reduced iron ore together with carbon carriers, the quantity of said carbon carriers being only slightly in excess of the stoichiometric quantity required to reduce said iron ore into said electro-slag resistance furnace;

(d) smelting said pre-reduced iron ore and carbon carriers in said electro-slag resistance furnace to produce steel having a relatively low vanadium concentration and a slag layer containing both vanadium and a relatively low concentration of iron oxides;

(e) tapping said steel from said electro-slag resistance furnace;

(f) separately tapping said slag layer from said electro-slag resistance furnace;

(g) charging said tapped slag layer into an electro-reduction furnace; and (h) processing said tapped slag layer in said electro-reduction furnace into smelted crude iron having a relatively high vanadium concentration.

2. A method as claimed in claim 1, further comprising:

(a) transferring the vanadium from said crude iron having a relatively high vanadium concentration into a slag rich in vanadium oxides by further smelting said crude iron having a relatively high vanadium concentration under oxidizing conditions.

3. The method as claimed in claim 2, further comprising:

(a) said transferring step is carried out in a shaking pan; and (b) said vanadium oxides are $V_2O_5$.

4. The method as claimed in claim 1, wherein said iron ore also contains titanium, the method further comprising:

(a) separately tapping a slag layer rich in titanium oxides from said electroreduction furnace.

5. A method of producing low carbon steel having a relatively high titanium concentration from iron ore containing titanium, comprising the steps of:

(a) pre-reducing said iron ore in a pre-reduction oven;

(b) lining an electro-slag resistance furnace with a refractory material selected according to the desired composition of the molten slag layer;

(c) charging said pre-reduced iron ore together with carbon carriers, the quantity of said carbon carriers being only slightly in excess of the stoichiometric quantity required to reduce said iron ore directly into said electro-slag resistance furnace;

(d) smelting said pre-reduced iron ore and carbon carriers into said electro-slag resistance furnace to produce steel having a relatively low titanium concentration and a slag layer containing both titanium and a relatively low concentration of iron oxides;

(e) tapping said steel from said electro-slag resistance furnace;

(f) separately tapping said slag layer from said electro-slag resistance furnace;

(g) charging said tapped slag layer into an electro-reduction furnace; and (h) processing said tapped slag layer in said electro-reduction furnace into smelted crude iron having a relatively high titanium concentration.

6. A method as claimed in claim 4, further comprising the step of:

(a) transferring the titanium from said crude iron having a relatively high titanium concentration into a slag rich in titanium oxides by further smelting said crude iron having a relatively high titanium concentration under oxidizing conditions.

* * * * *